US008230897B2

(12) United States Patent
Tamura et al.

(10) Patent No.: US 8,230,897 B2
(45) Date of Patent: Jul. 31, 2012

(54) LOW-PRESSURE CASTING APPARATUS AND A METHOD FOR FILLING IT WITH INERT GAS

(75) Inventors: Takahiro Tamura, Toyokawa (JP); Yutaka Murata, Toyokawa (JP)

(73) Assignee: Sinokogio, Ltd., Aichi (JP)

( * ) Notice: Subject to any disclaimer, the term of this patent is extended or adjusted under 35 U.S.C. 154(b) by 0 days.

(21) Appl. No.: 12/595,121

(22) PCT Filed: Apr. 1, 2008

(86) PCT No.: PCT/JP2008/056487

§ 371 (c)(1),
(2), (4) Date: Oct. 8, 2009

(87) PCT Pub. No.: WO2008/126726

PCT Pub. Date: Oct. 23, 2008

(65) Prior Publication Data

US 2010/0108283 A1 May 6, 2010

(30) Foreign Application Priority Data

Apr. 9, 2007 (JP) ..... 2007-101220

(51) Int. Cl.
*B22D 18/04* (2006.01)
*B22D 39/06* (2006.01)

(52) U.S. Cl. ..... 164/66.1; 164/119; 164/259; 164/306; 164/337

(58) Field of Classification Search ..... 164/119, 164/284, 306, 259, 66.1, 337
See application file for complete search history.

(56) References Cited

U.S. PATENT DOCUMENTS

2007/0215308 A1* 9/2007 Matsubara et al. ..... 164/306

FOREIGN PATENT DOCUMENTS

| | | | |
|---|---|---|---|
| JP | 8-25001 B2 | | 9/1992 |
| JP | 8-71727 A | | 3/1996 |
| JP | 3106941 B2 | | 7/1997 |
| JP | 2006-122910 | | 5/2006 |
| JP | 2006-122910 A | * | 5/2006 |

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

A low-pressure casting apparatus that prevents molten metal that is a residue in a conduit from being oxidized. The low-pressure casting apparatus includes a compartment for holding a molten metal 1, a pressure chamber 2 that can communicate with the compartment, wherein the molten meal is pressurized in the chamber, an on-off valve 5 that opens and closes hole 4 through which the compartment can communicate with the pressure chamber, a conduit 7 that conducts the molten metal to the mold 6, wherein the base of the conduit is connected to a lower part of the chamber so as to communicate with the chamber, the end of the conduit being made so that it can communicate with a sprue for a mold 6, a float 9 that goes up and down in the pressure chamber, and a tank that stores an inert gas and that has a pipe 13 that is connected to the upper part of the pressure chamber 2. The base of the conduit is connected to the pressure chamber so that the conduit can communicate with a space that is formed above the molten metal in the pressure chamber, when the level of the molten metal is lowered by raising the float after the molten metal in the mold has solidified, the mold having been filled with the molten metal by lowering and immersing the float in it which causes the level of the metal to rise.

3 Claims, 3 Drawing Sheets

LOW-PRESSURE CASTING APPARATUS AND A METHOD FOR FILLING IT WITH INERT GAS

FIELD OF THE INVENTION

The present invention relates to a low-pressure casting apparatus and a method for filling it with an inert gas.

BACKGROUND OF THE INVENTION

The applicant has proposed a low-pressure furnace for metal casting and has filed it as a patent application. The furnace can pressurize the molten metal in a pressure chamber with high precision. Also, it can greatly reduce the usage of inert gas, compared to a conventional furnace. The low-pressure furnace puts a pressure chamber next to a compartment for holding the molten metal wherein the chamber can communicate with the compartment. An isolation valve for molten metal is placed where the compartment and the pressure chamber are in communication with each other. A conduit for communicating is arranged downstream of the pressure chamber so that it can communicate with the sprue at the end of the conduit. A float is provided in the pressure chamber. The float is moved up and down by a electric cylinder that transforms the revolving movement to a linear movement via a screw mechanism. A pipe is provided on the pressure chamber. An inert gas is supplied to exhaust air in the pressure chamber through the pipe. (See Japanese Patent Laid-open Publication No. 2006-122910.)

However, in this conventional low-pressure furnace for metal casting, after the float is raised, when the casting that is a result of solidification of the molten metal is taken out of the mold, air comes through the mold into the conduit. Accordingly, the surface of the molten metal in the conduit is oxidized and an oxidized film forms on it. In addition, when the casting is taken out of the mold, the molten metal that has been maintained in the conduit up to the same height of a sprue rapidly falls by means of the atmospheric pressure. Therefore, the molten metal at the end of the conduit is agitated. As a result, it causes problems such as the oxidized film getting into a casting that is being cast. This causes a defective casting.

The present invention is aimed to resolve this problem. Namely, it is aimed to provide a low-pressure casting apparatus and a method for filling it with an inert gas, which can prevent the molten metal that is a residue in a conduit from being oxidized. A conduit in the apparatus is connected to a lower part of a pressure chamber in which the molten metal is pressurized. Also, the end of the conduit is made so that it can communicate with a sprue for a mold.

SUMMARY OF THE INVENTION

The low-pressure casting apparatus of the present invention, which is aimed to resolve the problem, comprises a compartment for holding the molten metal, a pressure chamber, an on-off valve, a conduit, a float, and means for supplying an inert gas to an upper part inside the chamber. The pressure chamber is provided so that it can communicate with the compartment. In the chamber, the molten metal is pressurized. The on-off valve can open and close a hole through which the compartment can communicate with the pressure chamber. The base of the conduit is connected to a lower part of the chamber so as to communicate with the chamber. The end of the conduit is made so that it can communicate with a sprue for a mold. The conduit conducts the molten metal to the mold. The float is provided in the pressure chamber so that a electric cylinder can move it up and down. In the apparatus, the float is immersed in the molten metal and causes the level of the molten metal to be raised. Thus, it causes the mold to be filled with the molten metal. The base of the conduit is connected to the pressure chamber at a predetermined height of the chamber. Since they are connected at that height, after the molten metal in the mold is solidified and then the float is raised and the level of the molten metal goes down, then the conduit can communicate with the space that is formed above the molten metal in the pressure chamber.

By one embodiment of the present invention, the inert gas is supplied to the space above the molten metal in the pressure chamber by the means for supplying an inert gas. Also, the gas is vented through an opening for exhausting the gas so as not to increase the pressure of this space above a predetermined value. Then a hole through which the compartment for holding the molten metal communicates with the pressure chamber is opened, and it lets the molten metal in the compartment flow into the chamber. Then, the hole is closed. Next, the shaft of the electric cylinder is extended. This causes the float to be immersed in the molten metal. Accordingly, the level of the molten metal is raised and the molten metal flows into the cavity of the mold through the conduit. After the molten metal in the cavity of the mold is solidified, the shaft of the cylinder is retracted so that the float is raised. Thus, the level of the molten metal in the pressure chamber becomes lower. Accordingly, the space that is formed above the molten metal in the pressure chamber communicates with the conduit, and the inert gas in the chamber goes into the conduit. Thus, the molten metal in the conduit can be prevented from being exposed to air.

As discussed above, in the embodiment of the present invention the float is immersed in molten metal so as to have its level be raised and have the molten metal flow into a mold. The base of the conduit is connected to the pressure chamber at a certain position. Since they are connected at that position, when the float is raised and the level of the molten metal goes down, the conduit can communicate with the space that is formed above the molten metal in the pressure chamber. Accordingly, the inert gas in the chamber goes into the conduit. Thus, the molten metal in the conduit is prevented from being exposed to the air. Therefore, the invention can achieve an excellent effect in that it can prevent the generation of an oxidized film on the molten metal.

BEST MODE FOR CARRYING OUT THE INVENTION

Now we discuss the details of one embodiment of the low-pressure casting apparatus of the present invention, based on FIGS. 1-3. As in FIG. 1, the low-pressure casting apparatus comprises a compartment for holding the molten metal 1, a pressure chamber 2, an on-off valve 5, a conduit 7, a float 9, and a means for supplying an inert gas (not shown). The compartment for holding the molten metal 1 holds the molten metal in it. The pressure chamber 2 is provided so that it can communicate with the compartment 1. In the chamber 2, the molten metal is pressurized. The on-off valve 5 opens and closes a hole 4 through which the compartment 1 can communicate with the pressure chamber 2 through an auxiliary chamber 3. The base of the conduit 7 is connected to a lower part of the chamber 2 so as to communicate with the chamber 2. The end of the conduit 7 is made so that it can communicate with a sprue for a mold 6 that can be horizontally split. The conduit 7 conducts the molten metal to the mold 6. The float 9 is provided in the pressure chamber 2 so that it can be moved up and down by a electric cylinder 8. The means for supplying an inert gas supplies an inert gas to the upper part inside the chamber.

The conduit 7 is constructed as follows. Namely, in the apparatus, first, the float 9 is immersed in the molten metal and causes the level of the molten metal to be raised and causes the mold 6 to be filled with it. Then after the molten metal in the mold 6 is solidified, the float 9 is raised so as to lower the level of the molten metal. The base of the conduit 7 is connected to the pressure chamber 2 at a predetermined height. Since they are connected at that height, when the float 9 is raised and the level of the molten metal goes down, the conduit 7 can communicate with the space that is formed above the molten metal in the chamber 2. The electric cylinder 8 is made so as to transform the revolving movement of the servomotor 10 to a linear movement, by a screw mechanism 11 under the control of a controller (not shown). As in FIG. 1, the low-pressure casting apparatus has a level sensor that detects the upper limit level L1 and lower limit level L2 of the molten metal in the compartment for holding the molten metal 1, and that detects the upper limit level L3 of the molten metal in the pressure chamber 2. The means for supplying an inert gas comprises a tank that stores an inert gas and that has a pipe 13 that is connected to a hole for supplying the inert gas through an on-off valve. A hole for exhausting the gas 12 is located on the upper part of the pressure chamber 2 so as to prevent the pressure of the space above the molten metal inside the chamber 2 from increasing too much. A valve for controlling the flow of the gas is fixed to the hole 12 (not shown).

In the apparatus, the means for supplying supplies an inert gas to the upper portion of the pressure chamber 2. Also, the inert gas goes out via the hole for exhausting the gas 12 so as to prevent the pressure of the space above the molten metal inside the chamber 2 from increasing too much. The on-off valve 5 is operated to open the hole for communication 4 so as to supply the molten metal inside the compartment 1 to the pressure chamber 2 until the level of the molten metal reaches the height of the upper limit L3. Next, the on-off valve 5 is operated to close the hole 4 (see FIG. 2-A). Then the shaft of the electric cylinder 8 is extended to cause the float 9 to go down to be immersed in the molten metal inside the pressure chamber 2 and to raise its level. Accordingly, because of the pressure head of the molten metal inside the pressure chamber 2, the molten metal flows into the cavity of the mold 6 through the conduit 7 to fill it (see FIG. 2-B).

After the molten metal in the cavity of the mold 6 is solidified, the shaft of the cylinder 8 is retracted to raise the float 9 by a predetermined height, under the control of a controller. Accordingly, the level of the molten metal in the chamber 2 moves down. Meanwhile, since the end of the conduit 7 is plugged by the casting made of the solidified molten metal in the cavity of the mold 6, the molten metal inside the conduit 7 remains in it. Then, under the control of a controller, the cylinder 8 has its shaft further retracted, at a low speed, to raise the float 9. Thus, the level of the upper surface of the molten metal in the chamber 2 moves down some more. Accordingly, the space above the molten metal inside the pressure chamber 2 communicates with the conduit 7 and the inert gas inside the chamber 2 flows into the conduit 7. Simultaneously, the molten metal in the auxiliary chamber 3 flows into the pressure chamber 2 without the molten metal being agitated and without the inert gas being mixed with it (see FIG. 2-C).

As in FIG. 3, the process using the low-pressure casting apparatus may comprise taking out the casting made of a solidified molten metal from a cavity after separating the cope from the drag of a mold 6, making the cavity by putting the cope on the drag, and causing the inert gas inside a pressure chamber 2 to flow into the cavity through the conduit 7, to fill it up.

Figure 1:
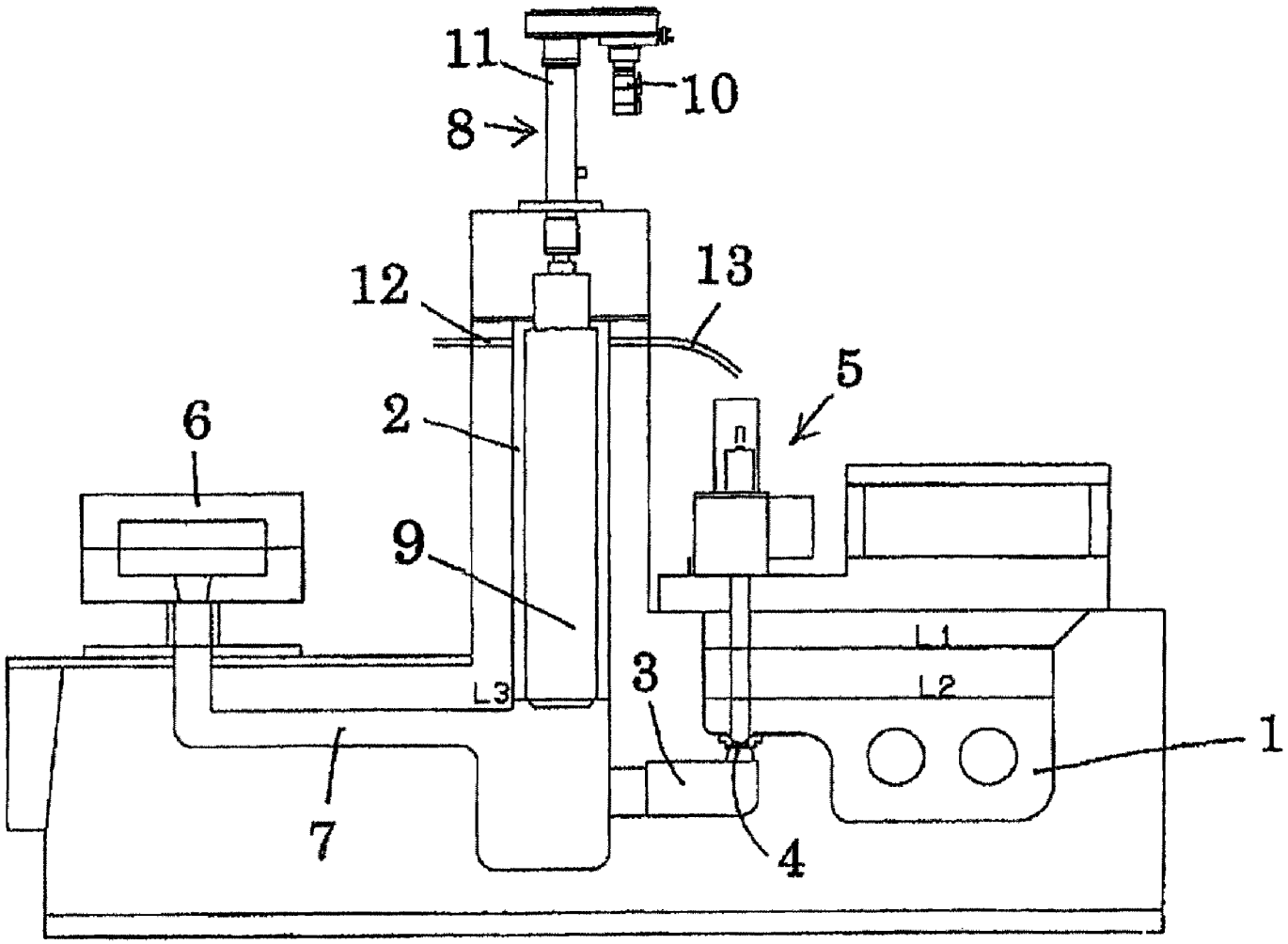
FIG. 1 is a vertical cross-sectional view of the low-pressure casting apparatus of the present invention.
Figure 2:
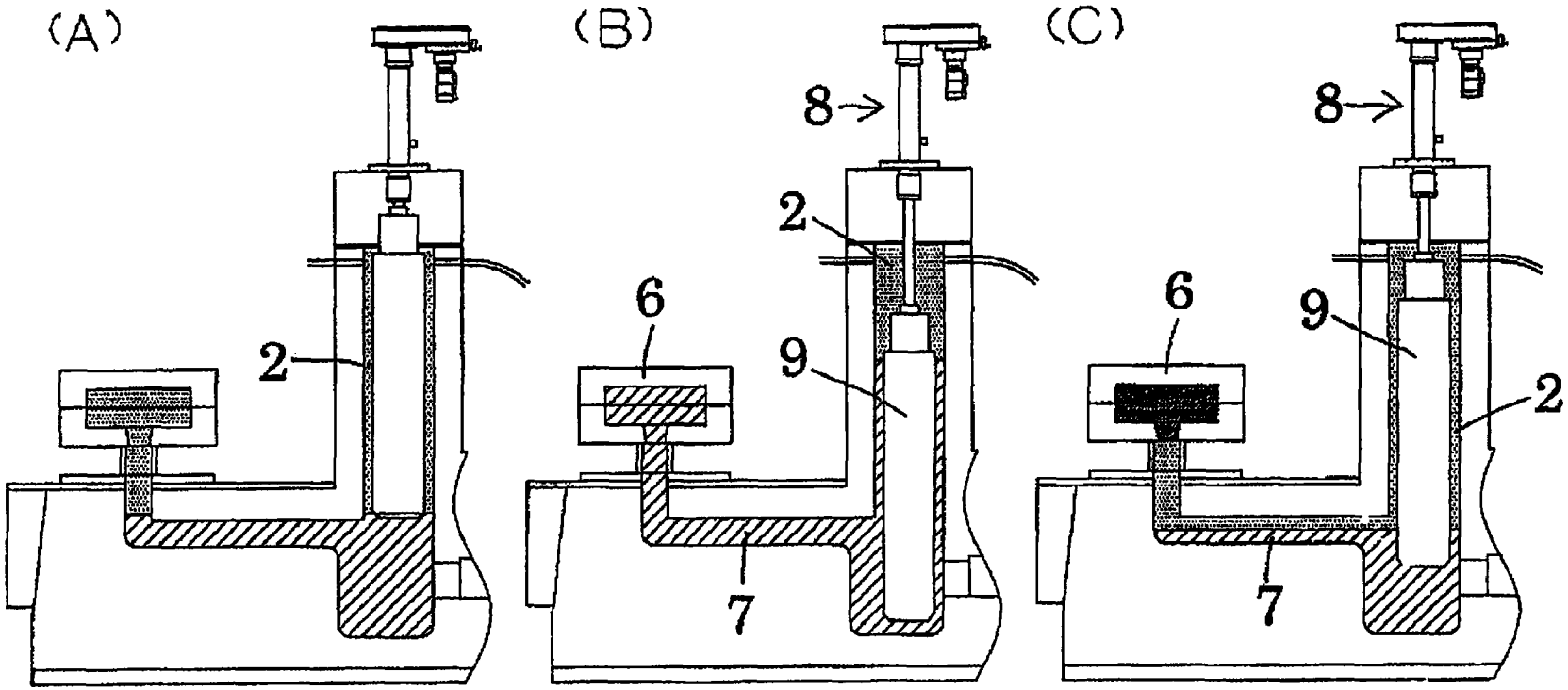
FIGS. 2-A-C are explanatory drawings of the low-pressure casting apparatus of FIG. 1.
Figure 3:
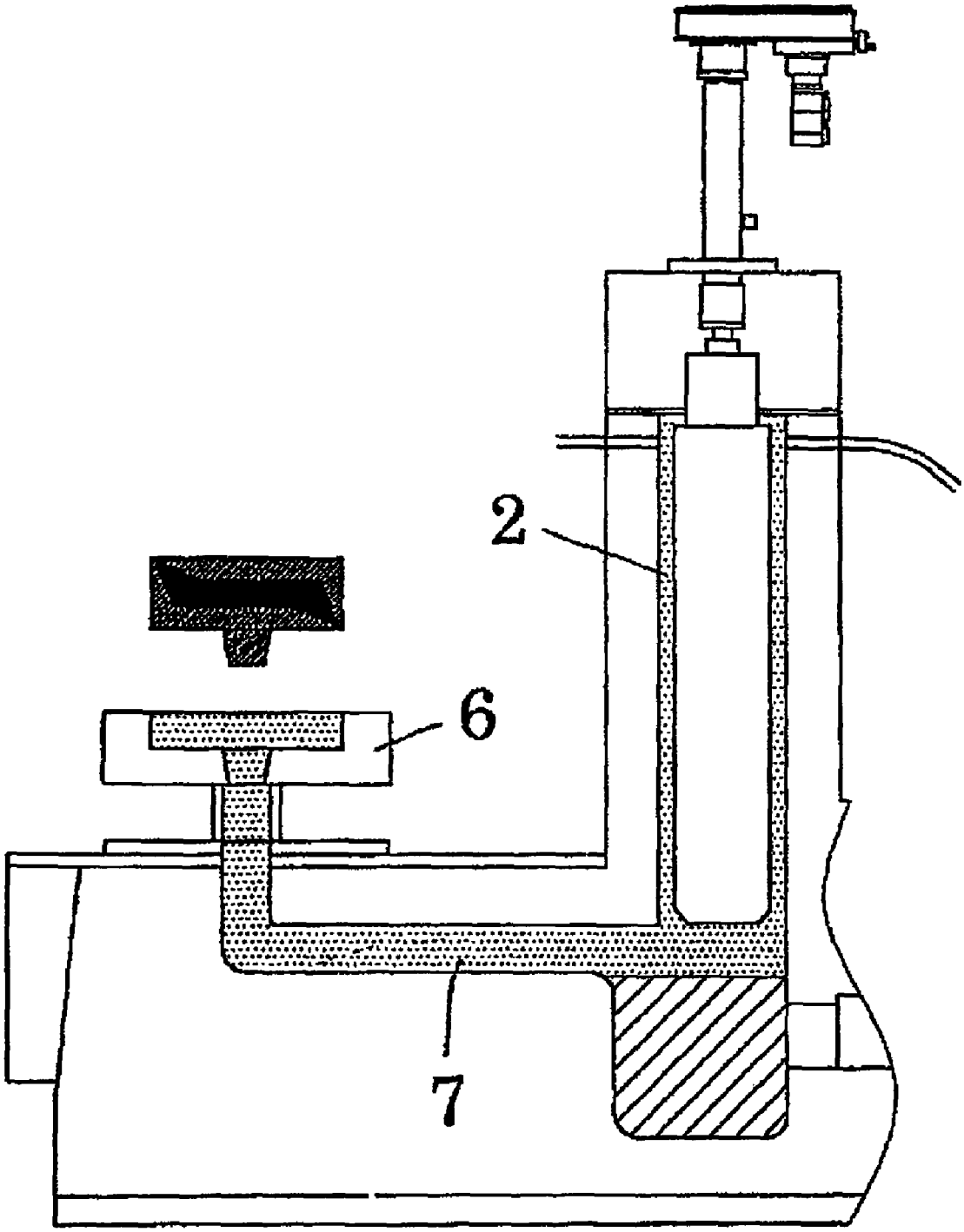
FIG. 3 is an explanatory drawing showing how to fill an inert gas in the mold of the low-pressure casting apparatus of FIG. 1.

What is claimed:

1. A low-pressure casting apparatus comprising a compartment for holding a molten metal, a vertically extending pressure chamber having a bottom that communicates with the compartment, wherein the molten metal can be pressurized in the chamber, an on-off valve that opens and closes an opening through which the compartment can communicate with the pressure chamber, a horizontally extending conduit that communicates the pressure chamber with a mold to conduct the molten metal to the mold, wherein one end of the horizontally extending conduit is connected to a lower part of the vertically extending pressure chamber at a level spaced vertically upward from the bottom of the pressure chamber to communicate the conduit with the chamber, an opposite end of the conduit communicating with a sprue of the mold, wherein the level at which the conduit is connected to the pressure chamber is vertically higher than a level at which the compartment communicates with the pressure chamber, a float in the pressure chamber and an electric cylinder for raising and lowering the float vertically up and down in the pressure chamber, and means for supplying an inert gas to an upper part of the interior of the pressure chamber, wherein the mold is filled with molten metal by flowing molten metal from the compartment into the pressure chamber and the horizontally extending conduit and thereafter by lowering the float in the chamber which causes the level of molten metal to rise and enter the mold and wherein the level at which the horizontally extending conduit is connected to the lower part of the vertically extending pressure chamber permits a space formed in an upper part of the conduit to communicate with a space in the upper part of the interior of the pressure chamber that contains the inert gas when the float is raised and the level of the molten metal in the chamber and the conduit is lowered after the molten metal in the mold has solidified.

2. A method of operating a low-pressure casting apparatus having a compartment for holding molten metal, a vertically extending pressure chamber that communicates with the compartment, a horizontally extending conduit that communicates the pressure chamber with a mold having a cavity, one end of the conduit being connected to a lower part of the pressure chamber and the opposite end to a sprue of a mold and a float vertically moveable in the pressure chamber, the method comprising:

flowing molten metal from the compartment into the pressure chamber and the conduit;

supplying inert gas to an upper part of the interior of the pressure chamber;

lowering the float in the chamber which causes the level of molten metal to rise and fill the cavity of the mold; and after the molten metal in the mold has solidified to form a casting, lowering the level of the molten metal in the pressure chamber by raising the float so that the inert gas in the upper part of the pressure chamber communicates with an upper part of the conduit, whereby the inert gas in the pressure chamber flows into the conduit and the sprue of the mold.

3. The method of operating the low-pressure casting apparatus of claim 2, further comprising:

removing the casting from the cavity, whereby the inert gas in the conduit flows into the cavity of the mold.

* * * * *